US011326807B2

(12) United States Patent
Mercer et al.

(10) Patent No.: US 11,326,807 B2
(45) Date of Patent: May 10, 2022

(54) CONDENSATE RECEPTOR FOR VERTICAL MOUNTED V-COIL HEAT EXCHANGER

(71) Applicant: Carrier Corporation, Palm Beach Gardens, FL (US)

(72) Inventors: Kevin Mercer, Danville, IN (US); James Amick, Danville, IN (US); Charles Christensen Phillips, Indianapolis, IN (US); Vishnu Shayan Nvss, Telangana (IN); Pratap Kumar Dvs, Telangana (IN); Asad M. Sardar, Avon, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 176 days.

(21) Appl. No.: 16/880,267

(22) Filed: May 21, 2020

(65) Prior Publication Data

US 2020/0378648 A1 Dec. 3, 2020

(30) Foreign Application Priority Data

May 31, 2019 (IN) ..... 201911021821

(51) Int. Cl.
*F24F 13/30* (2006.01)
*F24F 13/22* (2006.01)
*F28F 17/00* (2006.01)

(52) U.S. Cl.
CPC ..... *F24F 13/222* (2013.01); *F28F 17/005* (2013.01); *F24F 13/30* (2013.01); *F24F 2013/227* (2013.01)

(58) Field of Classification Search
CPC .... F24F 13/222; F24F 13/30; F24F 2013/227; F28D 1/0443; F28D 1/05383; F28F 17/005
See application file for complete search history.

(56) References Cited

U.S. PATENT DOCUMENTS

| | | | | |
|---|---|---|---|---|
| 9,429,373 | B2 | 8/2016 | Park et al. | |
| 9,777,962 | B2 | 10/2017 | Mastroianni et al. | |
| 10,240,853 | B2 | 3/2019 | Mercer et al. | |
| 2010/0041327 | A1* | 2/2010 | Desler | F24F 7/06 454/184 |
| 2011/0232861 | A1* | 9/2011 | Stewart | F24F 13/22 165/59 |

(Continued)

FOREIGN PATENT DOCUMENTS

| | | | |
|---|---|---|---|
| CN | 101995172 | B | 1/2013 |
| CN | 106524595 | A | 3/2017 |
| CN | 206073785 | U | 4/2017 |

(Continued)

*Primary Examiner* — Filip Zec
(74) *Attorney, Agent, or Firm* — Cantor Colburn LLP

(57) ABSTRACT

Disclosed is a receptor for receiving condensate from a v-coil heat exchanger (v-coil), the receptor having: a first channel having a first length defined between first opposing ends, the first channel configured to receive the v-coil; a second channel having a second length defined between second opposing ends, the second channel including: a first orifice intermediate the second opposing ends for receiving condensate from the first channel, the first orifice being fluidly connected to one end of the first opposing ends at a junction; and a fluid drain port at one or both of the second opposing ends.

18 Claims, 5 Drawing Sheets

(56) References Cited

U.S. PATENT DOCUMENTS

2011/0265508 A1* 11/2011 Piccione ..... F24F 13/222
62/291

FOREIGN PATENT DOCUMENTS

| | | | |
|---|---|---|---|
| CN | 206176821 | U | 5/2017 |
| CN | 104764353 | B | 7/2017 |
| CN | 107843031 | A | 3/2018 |
| CN | 207688711 | U | 8/2018 |
| CN | 206739939 | U | 10/2018 |
| JP | 2014105964 | A | 6/2014 |
| KR | 20180108231 | A | 10/2018 |
| WO | 2018116133 | A1 | 6/2018 |

* cited by examiner

CONDENSATE RECEPTOR FOR VERTICAL MOUNTED V-COIL HEAT EXCHANGER

CROSS-REFERENCE TO RELATED APPLICATIONS

This application claims the benefit of Indian Patent Application No. 201911021821 filed May 31, 2019, the disclosure of which is incorporated herein by reference in its entirety.

BACKGROUND

The disclosed embodiments relate to cooling systems and more specifically to a condensate receptor for an air conditioning evaporator coil that is a v-coil heat exchanger (v-coil).

An evaporator coil is used with air conditioner (AC) systems. The evaporator coil becomes cold when the unit operates. It is mounted in (or connected in line with) the ductwork of, for example, a home. When the system is on, air flows through the coil and the cold air is distributed throughout the home. AC systems may use a microchannel heat exchanger (MCHX) as an evaporator, where the MCHX may be configured as a v-coil heat exchanger (v-coil), which may be mounted vertically in a housing. It is desirable to provide a condensate receptor that is effective in capturing condensate from an MCHX for removing the condensate from the housing.

SUMMARY

Disclosed is a receptor for receiving condensate from a v-coil heat exchanger (v-coil), the receptor comprising: a first channel having a first length defined between first opposing ends, the first channel configured to receive the v-coil; a second channel having a second length defined between second opposing ends, the second channel including: a first orifice intermediate the second opposing ends for receiving condensate from the first channel, the first orifice being fluidly connected to one end of the first opposing ends at a junction; and a fluid drain port at one or both of the second opposing ends.

In addition to one or more of the above disclosed features or as an alternate, the first channel is includes a bottom surface that is sloped between first opposing ends so that a first depth of the first channel, located at the junction, is deeper than a second depth of the first channel located at the other end of the first channel.

In addition to one or more of the above disclosed features or as an alternate, a first internal cross section of the first channel includes: a top portion of the first internal cross section that is arcuate; and a bottom portion of the first internal cross section that is frustoconical.

In addition to one or more of the above disclosed features or as an alternate, the top portion of the first internal cross section is semicircular.

In addition to one or more of the above disclosed features or as an alternate, the second channel has a second internal cross section that is rectangular.

In addition to one or more of the above disclosed features or as an alternate, the second channel includes a fluid drain port at each of the second opposing ends.

In addition to one or more of the above disclosed features or as an alternate, the first opposing ends include: an upstream end and a downstream end, the downstream end disposed at the junction; the upstream end including an upstream end wall having a shape that conforms with the first internal cross section; and the upstream end wall includes an upstream mounting hole configured to mount the receptor to an evaporator housing.

In addition to one or more of the above disclosed features or as an alternate, the downstream end includes a downstream end wall that is a partial end wall having a shape that conforms with the top portion of the first internal cross section; and the downstream end wall includes a downstream mounting hole configured to mount the receptor to the evaporator housing.

In addition to one or more of the above disclosed features or as an alternate, the first channel and the second channel are opened at top thereof between the first opposing ends, the second opposing ends, and at the junction.

Further disclosed is an evaporator assembly for air conditioning (AC) system comprising: a housing; a v-coil heat exchanger (v-coil) mounted within the housing; and a receptor mounted within the housing for receiving condensate from the v-coil, the receptor comprising one or more of the above disclosed features.

In addition to one or more of the above disclosed features or as an alternate, the first channel has a first length defined between first opposing ends, the first channel configured to receive the v-coil; and the receptor includes: a second channel having a second length defined between second opposing ends, the second channel including: a first orifice intermediate the second opposing ends for receiving condensate from the first channel, the first orifice being fluidly connected to one end of the first opposing ends at a junction; and a fluid drain port at one or both of the second opposing ends.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
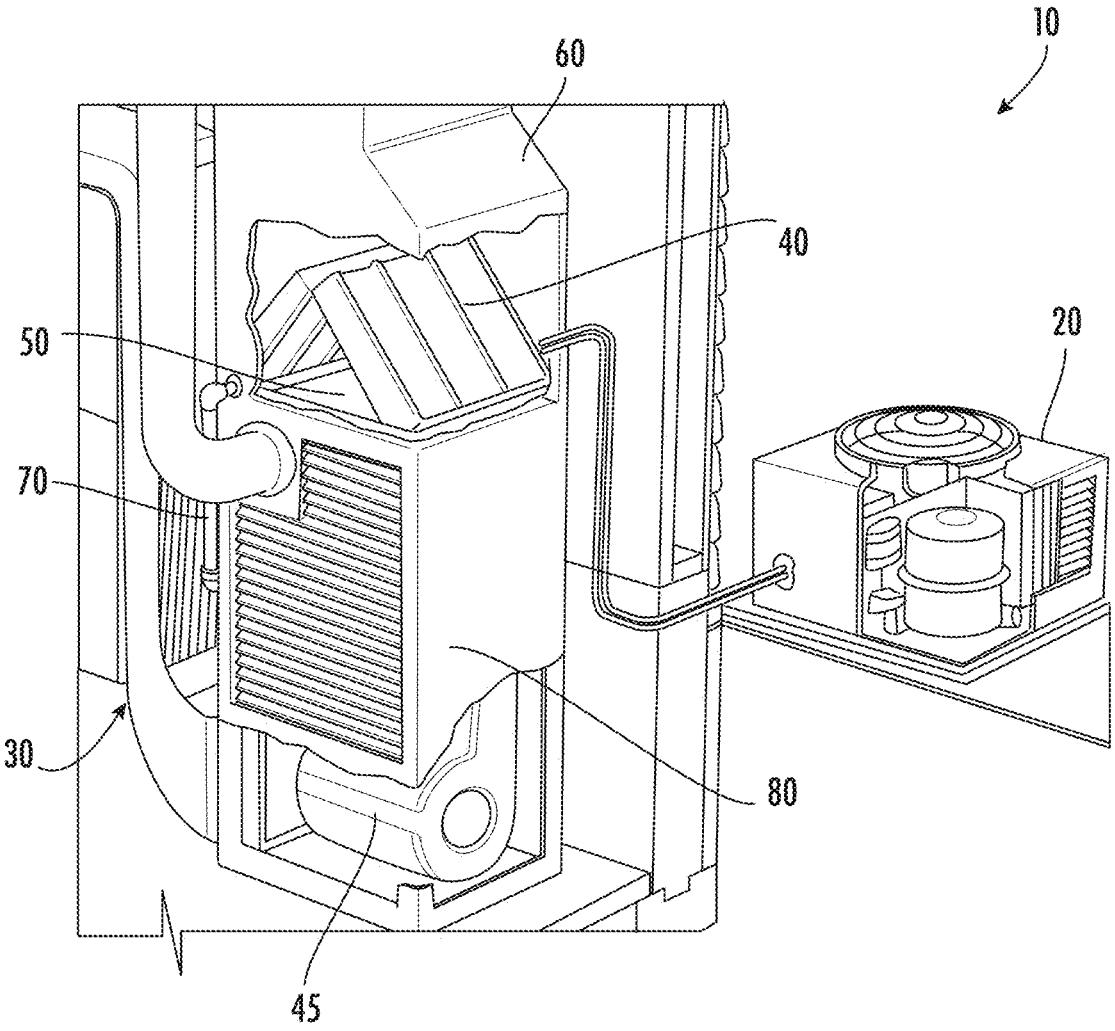
FIG. 1 illustrates an air conditioning system that may include or be modified to include one or more features of the disclosed embodiments.

FIG. 1 illustrates an air conditioning (AC) system 10. The system 10 includes a condenser assembly 20 and an evaporator assembly 30. The evaporator assembly 30, may also be referred to as an air handler, includes evaporator coils 40, a blower 45, a plenum 60 and evaporator drain lines 70. The illustrated coils 40 are formed form a heat exchanger and are configured as A-coils. The coils 40 are disposed over a drip pan 50, which may also be referred to as a condensate receptor. The evaporator assembly 20 also includes a housing 80. With the configuration of FIG. 1, effective draining of condensate from the A-coils 40 may be a challenge.

Figure 2B:
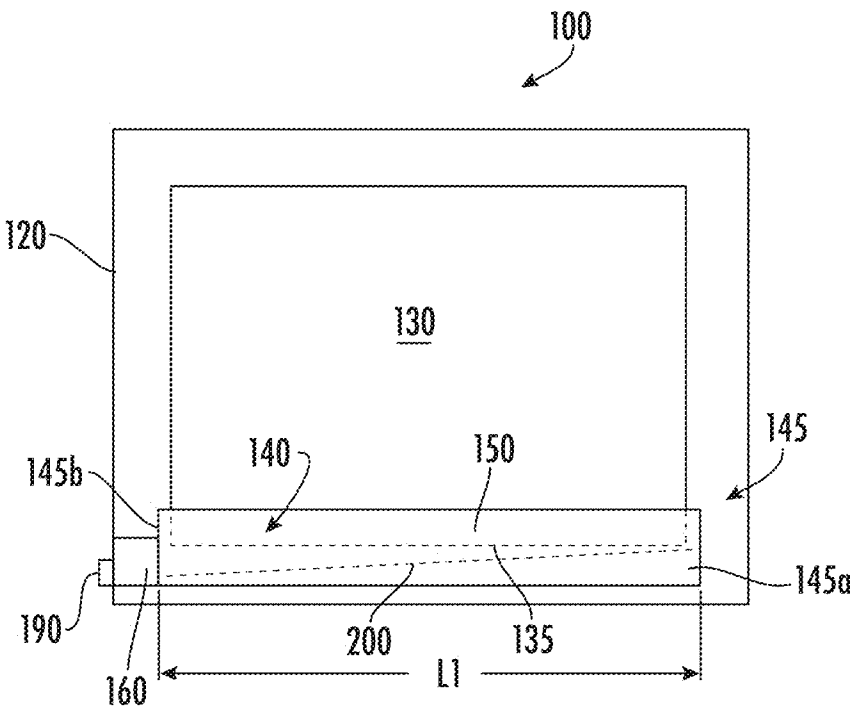
FIGS. 2A-2C illustrate a coil assembly including a v-coil and receptor within a housing according to an embodiment.
Figure 2A:
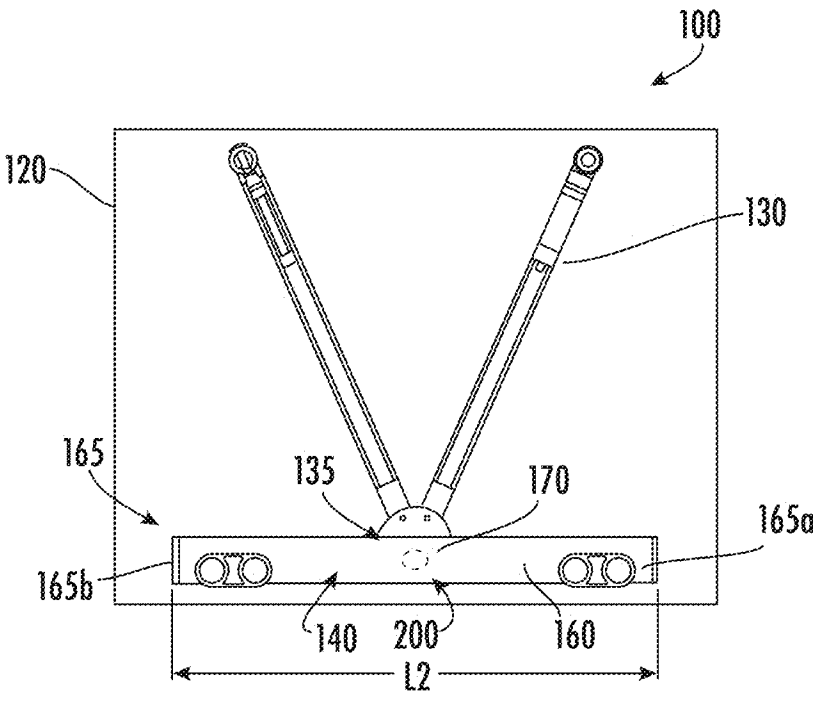
Figure 2C:
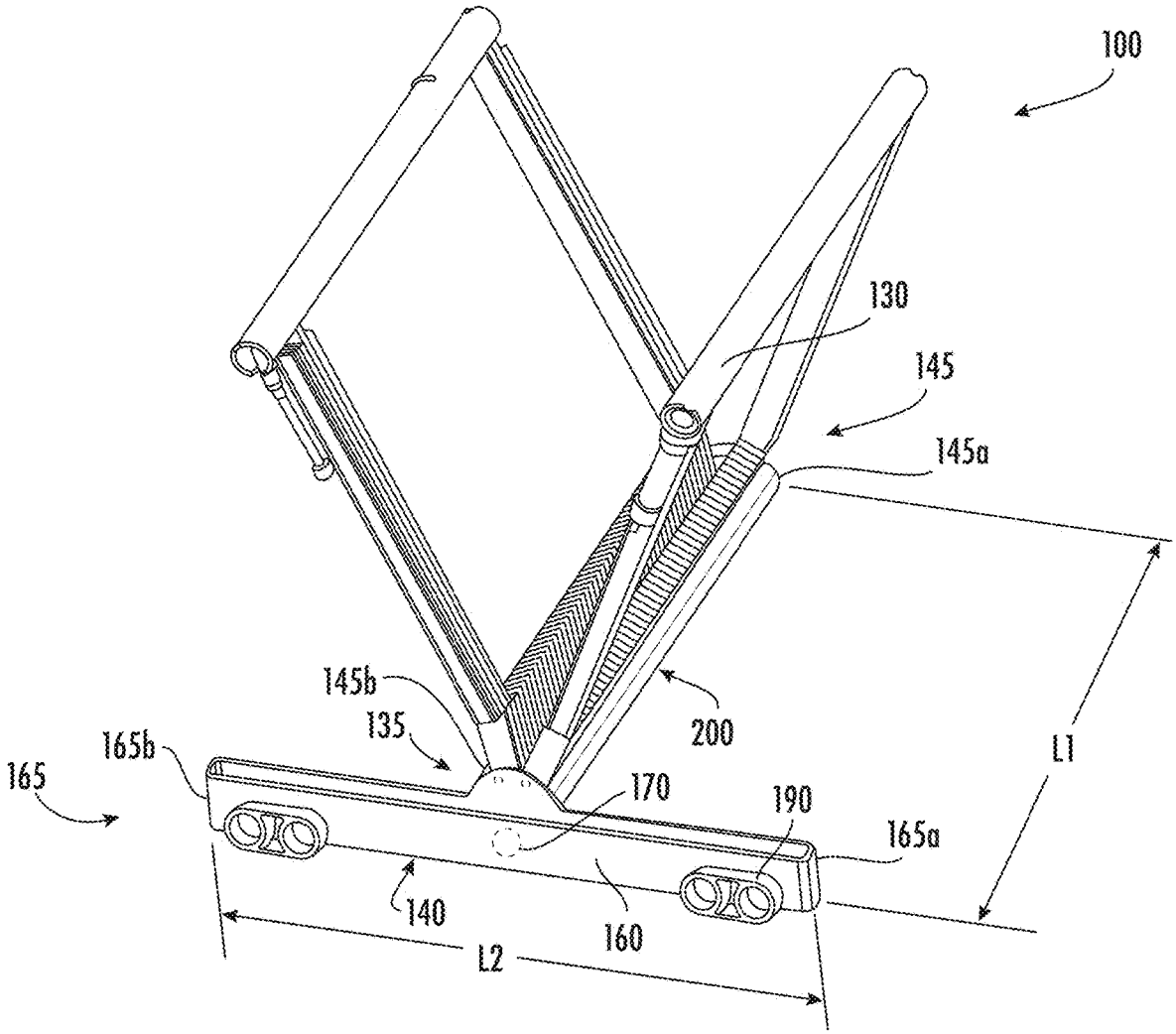

Turning to FIGS. 2A-2C disclosed is an evaporator assembly 100 for the air conditioning (AC) system 10. The evaporator assembly 100 includes an evaporator housing 120 (not illustrated in FIG. 2), a microchannel heat exchanger configured as a v-coil 130 heat exchanger (v-coil) 130, which is vertically mounted within the evaporator housing 120. The v-coil 130 may be implemented utilizing a round tube plate fin constructions, instead of a microchannel heat exchanger. A condensate receptor (receptor) 140 is mounted within the evaporator housing 120, below the v-coil 130, for receiving condensate from the v-coil 130.

The receptor 140 includes a first channel 150 having a first length L1 defined between first opposing ends 145, including an upstream end 145*a* and a downstream end 145*b*. The first channel 150 is configured to receive the v-coil 130. A second channel 160 of the receptor 140 has a second length L2 defined second opposing ends 165, including a proximate end 165*a* and a distal end 165*b*. The second channel 160 is perpendicular to the first channel 150. The second channel 160 may include a first orifice 170 illustrated schematically intermediate the second opposing ends 165 for receiving condensate from the first channel 150.

Figure 3A:
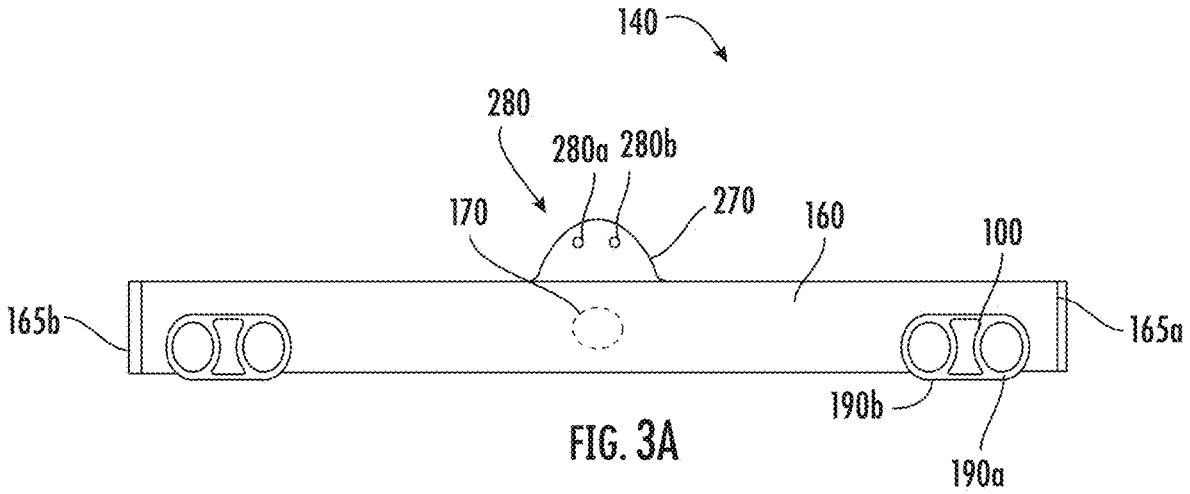
FIGS. 3A-3C illustrate a receptor according to an embodiment.
Figure 3B:
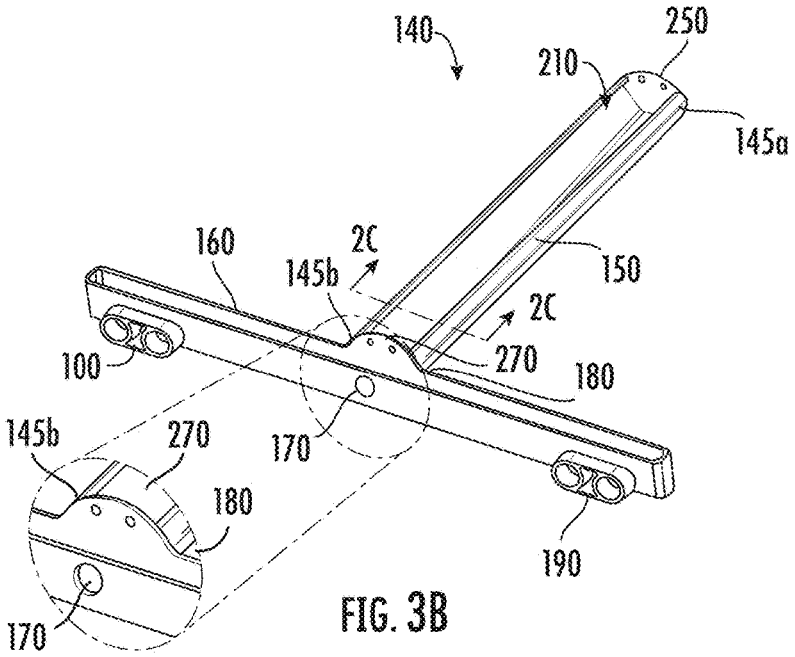
Figure 3C:
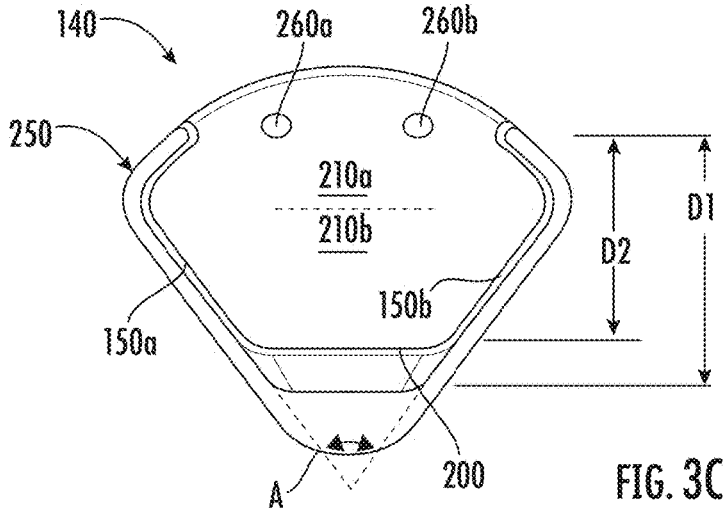

Turning to FIGS. 3A-3C, the first orifice 170 is fluidly connected to one end of the first opposing ends 145*a*, 145*b* and specifically the downstream end 145*b*, at a junction 180 which substantially defines a T-shape. For example the downstream end 145*b* opens into the second channel 160 to allow condensate to flow substantially unobstructed from the first channel 150 to the second channel 160. The second channel 160 includes a fluid drain port 190 at one or both of the second opposing ends 165*a*, 165*b*. The fluid drain port 190 may comprise a pair of ports 190*a*, 190*b* that are together disposed at the one or both of the second opposing ends 165*a*, 165*b*. Each port 190 has a circular profile for condensate drainage therethrough. As can be appreciated providing drain ports at both of the second opposing ends 165*a*, 165*b* increases an ability to drain condensate from the receptor 140. In addition, the drain ports 190 are configured to protrude from the housing 120 (FIG. 2B) to enable removing of the condensate from the assembly 100.

In an embodiment the first channel 150 may have a bottom surface 200 (FIG. 2B) that is sloped between first opposing ends 145*a*, 145*b*. From this configuration a first depth D1 of the first channel 150, located at the junction 180, is deeper than a second depth D2 of the first channel 150 located at the other end of the first channel 150.

In an embodiment the first channel 150 includes a first internal cross section 210 referenced in FIG. 3B and illustrated, for example, in FIG. 3C. The cross section 210 includes a top portion 210*a* that is arcuate, for example, semicircular, and a bottom portion 210*b* that is frustoconical. That is, in the bottom portion 210*b*, side surfaces 150*a*, 150*b* of the first channel 150 converge toward the bottom surface 200 of the first channel 150. A converging angle A between the surfaces 150*a*, 150*b* may be between approximately 50° and approximately 90°, which may be optimized to limit impact on the airflow. Other angle configurations, below 50° and above 90°, are within the scope of the disclosed embodiments so as to optimize performance. In an embodiment a shape of the top portion 210*a* of the first internal cross section 210 is constant between the first opposing ends 145*a*, 145*b*. The On the other hand, the second channel 160 has a second internal cross section that is rectangular.

When installing the v-coil 130, a bottom 135, such as a bottom apex, of the v-coil 130 may be positioned against at least part of the bottom surface 200 (FIGS. 2A-2B). This steadies the v-coil 130 during installation and, in addition, the shape of the converging orientation of the side surface 150*a*, 150*b* provide for vertical (upright) alignment of the v-coil 130 during installation.

In an embodiment the upstream end 145*a* of the first channel 150 includes an upstream end wall 250 (FIG. 3C) having a shape that conforms with the first internal cross section 210. The upstream end wall 250 includes an upstream mounting hole 260, which may be a set of holes 260*a*, 260*b*, configured to mount the receptor 140 to an evaporator housing 120. The downstream end 145*b* includes a downstream end wall 270 that is a partial end wall having a shape that conforms with at least the top portion 210*a* of the first internal cross section 210. Below the downstream end wall 270, the first orifice 170 provides for flow into the second channel 160, as indicated, to allow condensate to flow to the second channel 160. The downstream end wall 270 may include a downstream mounting hole 280 (FIG. 3A), which may be another set of holes 280*a*, 280*b*, configured to mount the receptor 140 to the evaporator housing 120.

Figure 4:
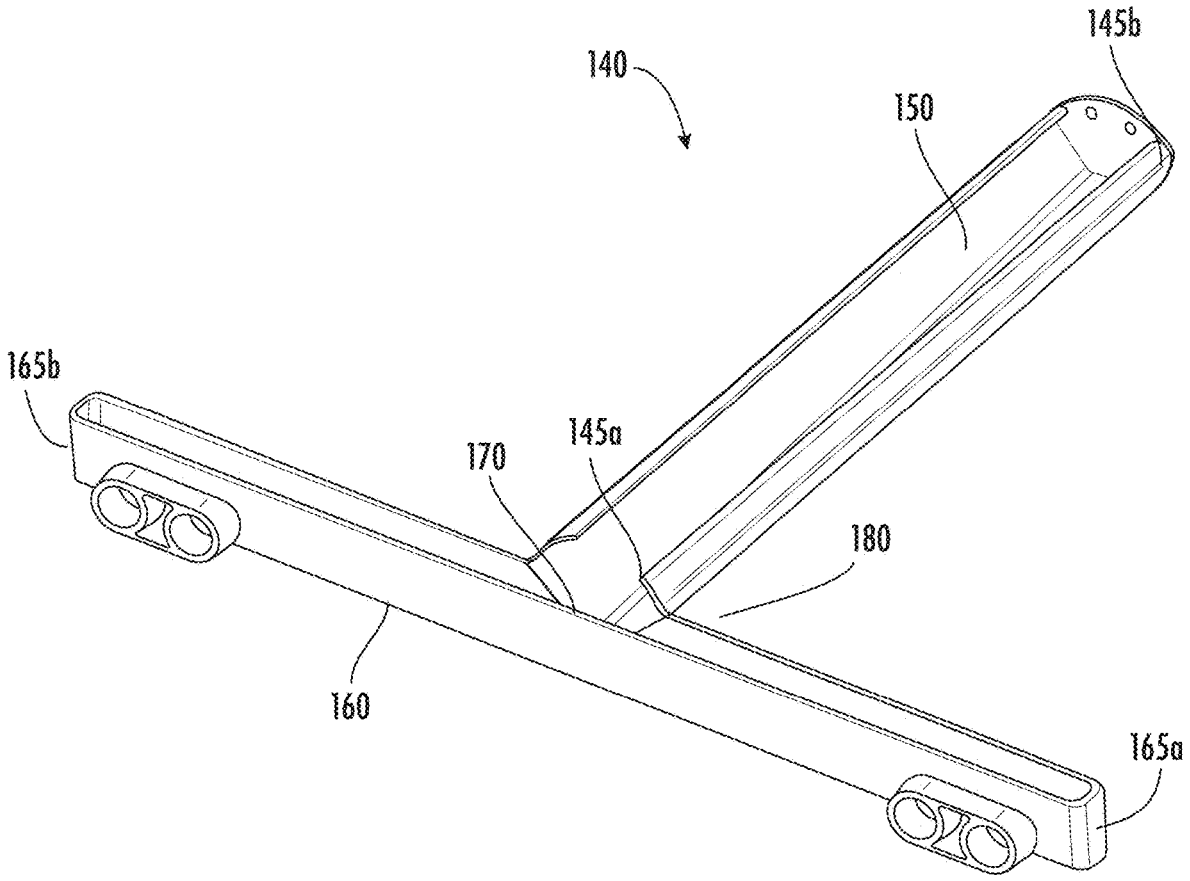
FIG. 4 illustrates a receptor according to an embodiment.

Turning to FIG. 4, an embodiment of the receptor 140 has each of the features of the embodiment illustrated in FIGS. 3A-3C except for the downstream end wall 270 in the first channel 150. Thus, the first channel 150 and second channel 160 are opened at a top thereof between the first opposing ends 145, the second opposing ends 165 and at the junction 180. In comparison, in the embodiment in FIGS. 3A-3C the first channel 150 and second channel 160 are opened at the top thereof between the first opposing ends 145, the second opposing ends 165, but the downstream end wall 270 provides an effective cover at the junction 180.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A receptor for receiving condensate from a v-coil heat exchanger (v-coil), the receptor comprising:

a first channel having a first length defined between first opposing ends, the first channel configured to receive the v-coil;

a second channel having a second length defined between second opposing ends, the second channel including:

a first orifice intermediate the second opposing ends for receiving condensate from the first channel, the first orifice being fluidly connected to one end of the first opposing ends at a junction; and a fluid drain port at one or both of the second opposing ends.

2. The receptor of claim 1, wherein:

the first channel is includes a bottom surface that is sloped between first opposing ends so that a first depth of the first channel, located at the junction, is deeper than a second depth of the first channel located at the other end of the first channel.

3. The receptor of claim 2, wherein:

a first internal cross section of the first channel includes:

a top portion of the first internal cross section that is arcuate; and a bottom portion of the first internal cross section that is frustoconical.

4. The receptor of claim 3, wherein:

the top portion of the first internal cross section is semi-circular.

5. The receptor of claim 4, wherein:

the second channel has a second internal cross section that is rectangular.

6. The receptor of claim 5, wherein:

the second channel includes a fluid drain port at each of the second opposing ends.

7. The receptor of claim 6, wherein:

the first opposing ends include:

an upstream end and a downstream end, the downstream end disposed at the junction;

the upstream end including an upstream end wall having a shape that conforms with the first internal cross section; and the upstream end wall includes an upstream mounting hole configured to mount the receptor to an evaporator housing.

8. The receptor of claim 7, wherein:

the downstream end includes a downstream end wall that is a partial end wall having a shape that conforms with at least the top portion of the first internal cross section; and the downstream end wall includes a downstream mounting hole configured to mount the receptor to the evaporator housing.

9. The receptor of claim 1, wherein:

the first channel and the second channel are opened at top thereof between the first opposing ends, the second opposing ends, and at the junction.

10. An evaporator assembly for air conditioning (AC) system comprising:

a housing;

a v-coil heat exchanger (v-coil) mounted within the housing;

a receptor mounted within the housing for receiving condensate from the v-coil, the receptor comprising:

a first channel having a first length defined between first opposing ends, the first channel configured to receive the v-coil;

a second channel having a second length defined between second opposing ends, the second channel including:

a first orifice intermediate the second opposing ends for receiving condensate from the first channel, the first orifice being fluidly connected to one end of the first opposing ends at a junction; and a fluid drain port at one or both of the second opposing ends.

11. The system of claim 10, wherein:

the first channel includes a bottom surface that is sloped between first opposing ends so that a first depth of the first channel, located at the junction, is deeper than a second depth of the first channel located at the other end of the first channel.

12. The system of claim 11, wherein:

a first internal cross section of the first channel includes:

a top portion of the first internal cross section that is arcuate; and a bottom portion of the first internal cross section that is frustoconical.

13. The system of claim 12, wherein:

the top portion of the first internal cross section is semi-circular.

14. The system of claim 13, wherein:

the second channel has a second internal cross section that is rectangular.

15. The system of claim 14, wherein:

the second channel includes a fluid drain port at each of the second opposing ends.

16. The system of claim 15, wherein:

the first opposing ends include:

an upstream end and a downstream end, the downstream end disposed at the junction;

the upstream end including an upstream end wall having a shape that conforms with the first internal cross section; and the upstream end wall includes an upstream mounting hole configured to mount the pan to an evaporator housing.

17. The system of claim 16, wherein:

the downstream end includes a downstream end wall that is a partial end wall having a shape that conforms with at least the top portion of the first internal cross section; and the downstream end wall includes a downstream mounting hole configured to mount the pan to the evaporator housing.

18. The system of claim 10, wherein:

the first channel and the second channel are opened at top thereof between the first opposing ends, the second opposing ends, and at the junction.

* * * * *